US010677267B2

(12) United States Patent
Kreischer

(10) Patent No.: US 10,677,267 B2
(45) Date of Patent: Jun. 9, 2020

(54) PNEUMATIC UNIT FOR A HYDROPNEUMATIC PRESSURE BOOSTER

(71) Applicant: TKR SPEZIALWERKZEUGE GMBH, Gevelsberg (DE)

(72) Inventor: Torsten Kreischer, Wetter (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 190 days.

(21) Appl. No.: 15/991,139

(22) Filed: May 29, 2018

(65) Prior Publication Data

US 2018/0340552 A1 Nov. 29, 2018

(30) Foreign Application Priority Data

May 29, 2017 (DE) ..... 10 2017 111 656

(51) Int. Cl.
*F15B 1/027* (2006.01)
*F15B 11/064* (2006.01)
(Continued)

(52) U.S. Cl.
CPC ..... *F15B 1/027* (2013.01); *F15B 3/00* (2013.01); *F15B 11/064* (2013.01);
(Continued)

(58) Field of Classification Search
CPC ..... F15B 1/027; F15B 1/0275; F15B 1/033; F15B 3/00; F15B 11/064; F15B 11/0725; F15B 11/032; F15B 20/004; F15B 2211/20515; F15B 2211/20538; F15B 2211/20576; F15B 2211/212; F15B 2211/214; F15B 2211/216; F15B 2211/2654; F15B 2211/30505;
(Continued)

(56) References Cited

U.S. PATENT DOCUMENTS 2,804,753 A * 9/1957 Leduc ..... B64C 13/24 91/28
3,044,481 A * 7/1962 Regan ..... E21B 33/06 137/114
(Continued)

FOREIGN PATENT DOCUMENTS

DE 3228494 A1 2/1984
DE 10242547 B4 11/2012

*Primary Examiner* — William M McCalister
(74) *Attorney, Agent, or Firm* — Laurence A. Greenberg; Werner H. Stemer; Ralph E. Locher

(57) ABSTRACT

A pneumatic unit for a hydropneumatic pressure booster has a system line that leads from a compressed air inlet to a compressed air outlet. A bypass line runs parallel to the system line and it is connected to the system line via first and second compressed air switches. A compressed air reservoir is connected in the bypass line, and a pressure intensifier is connected in the region between the first compressed air switch and the compressed air reservoir. The pneumatic unit makes available to the pressure booster a sufficiently high pneumatic pressure for carrying out at least one operational step of a connected hydraulic tool, even in the case of a pressure decrease or pressure failure in the supplying pneumatic line. For that purpose, the second compressed air switch is configured for switching the compressed air flow between the system line and the bypass line.

10 Claims, 5 Drawing Sheets

(51) Int. Cl.

| | |
|---|---|
| ***F15B 3/00*** | (2006.01) |
| ***F15B 20/00*** | (2006.01) |
| ***F15B 11/072*** | (2006.01) |
| *F15B 11/032* | (2006.01) |
| *B21J 15/22* | (2006.01) |

(52) U.S. Cl.

CPC ..... *F15B 11/0725* (2013.01); *F15B 20/004* (2013.01); *B21J 15/22* (2013.01); *F15B 11/032* (2013.01); *F15B 2211/20515* (2013.01); *F15B 2211/20538* (2013.01); *F15B 2211/20576* (2013.01); *F15B 2211/212* (2013.01); *F15B 2211/214* (2013.01); *F15B 2211/216* (2013.01); *F15B 2211/2654* (2013.01); *F15B 2211/3052* (2013.01); *F15B 2211/30505* (2013.01); *F15B 2211/30525* (2013.01); *F15B 2211/31535* (2013.01); *F15B 2211/329* (2013.01); *F15B 2211/6057* (2013.01); *F15B 2211/625* (2013.01); *F15B 2211/6309* (2013.01); *F15B 2211/6652* (2013.01); *F15B 2211/775* (2013.01); *F15B 2211/857* (2013.01); *F15B 2211/8633* (2013.01); *F15B 2211/8752* (2013.01); *F15B 2211/8757* (2013.01); *F15B 2211/8855* (2013.01); *Y10T 137/86171* (2015.04); *Y10T 137/87338* (2015.04)

(58) Field of Classification Search

CPC .... F15B 2211/3052; F15B 2211/30525; F15B 2211/31535; F15B 2211/329; F15B 2211/6057; F15B 2211/625; F15B 2211/6309; F15B 2211/6652; F15B 2211/775; F15B 2211/857; F15B 2211/8633; F15B 2211/8752; F15B 2211/8757; F15B 2211/8855; B21J 15/22; Y10T 137/86171; Y10T 137/87338

USPC ..... 137/565.35, 599.11

See application file for complete search history.

(56) References Cited

U.S. PATENT DOCUMENTS

| | | | | |
|---|---|---|---|---|
| 3,680,311 | A * | 8/1972 | Harbonn | E21B 33/0355 60/404 |
| 3,797,516 | A * | 3/1974 | Forster | F02C 9/24 137/340 |
| 4,036,106 | A * | 7/1977 | Athy, Jr. | F15B 11/08 91/5 |
| 4,647,004 | A * | 3/1987 | Bihlmaier | F15B 11/072 251/28 |
| 4,953,445 | A * | 9/1990 | Kervagoret | B62D 7/148 91/358 A |
| 2017/0114805 | A1* | 4/2017 | Lerner | F15B 1/26 |

* cited by examiner

PNEUMATIC UNIT FOR A HYDROPNEUMATIC PRESSURE BOOSTER

CROSS-REFERENCE TO RELATED APPLICATION

This application claims the priority, under 35 U.S.C. § 119, of German patent application DE 10 2017 111 656.7, filed May 29, 2017; the prior application is herewith incorporated by reference in its entirety.

BACKGROUND OF THE INVENTION

Field of the Invention

The invention relates to a pneumatic unit for a hydropneumatic pressure booster.

Hydropneumatic pressure boosters are known in the prior art, in numerous embodiments. Such devices serve, for example, for driving hydraulically driven hydraulic tools, which are used for punching, riveting, clinching or joining. The pressure booster may be employed, for example, to convert a pneumatic low pressure in the range of, say, 2 to 10 bar into a hydraulic high pressure of 100 to 600 bar. This hydraulic pressure can be used to drive working pistons of hydraulic tools connected to the pressure booster.

Pressure boosters of the type described above are employed inter alia in motor vehicle workshops, or body shops, where they are used, for example, to drive punching and riveting devices employed in vehicle repair. The pressure boosters are supplied via compressed air lines which are typically present in motor vehicle workshops; these lines can be directly coupled to the pressure boosters. When the level of pneumatic pressure remains continuously high, reliable operation of the pressure booster and of a hydraulic tool connected to the pressure booster can be ensured.

On the other hand, if the pressure in the pneumatic line supplying the pressure booster decreases, the problem arises that the pressure booster can no longer provide the hydraulic tool with the required level of hydraulic pressure needed for the work to be performed with the hydraulic tool. As an example, when using a riveting tool, the problem arises that the rivet to be set can no longer be set with the force prescribed for the rivet connection, with the result that the rivet connection is unreliable. In the event of a complete loss of pressure, the tool will immediately become inoperable, and accordingly it will be also impossible to complete the riveting process.

SUMMARY OF THE INVENTION

It is accordingly an object of the invention to provide a pneumatic unit for a pressure booster which overcomes the above-mentioned and other disadvantages of the heretofore-known devices and methods of this general type and which provides for a pneumatic unit which, even in the case of a decrease or failure in the pressure in the supplying pneumatic line, will provide the pressure booster with a sufficiently high pneumatic pressure to carry out at least one operational step of the connected hydraulic tool.

With the foregoing and other objects in view there is provided, in accordance with the invention, a pneumatic unit for a hydropneumatic pressure booster, the pneumatic unit comprising:

a compressed air inlet, a compressed air outlet, and a system line leading from said compressed air inlet to said compressed air outlet;

a bypass line connected in parallel with said system line between said compressed air inlet and said compressed air outlet;

a first compressed air switch and a second compressed air switch connecting said bypass line to said system line;

a compressed air reservoir connected in said bypass line; and a pressure intensifier connected between said first compressed air switch and said compressed air reservoir; and wherein said second compressed air switch is configured to switch a compressed air flow between said system line and said bypass line.

In the context of the invention, the term "pneumatic unit" is understood to mean a device which is configured for temporarily supplying pneumatic pressure to a hydraulic pressure booster, thereby enabling one to carry out at least one operational step of a hydraulic tool which is connected to said hydraulic pressure booster. Here the device according to the invention is preferably used such that it is interposed between a supplying pneumatic line and the hydraulic pressure booster.

Once more, the primarily important features for the novel pneumatic unit according to the invention are a system line leading from a compressed air inlet to a compressed air outlet; a bypass line which runs parallel to the system line and which is connected in the region between the compressed air inlet and the compressed air outlet to the system line via a first compressed air switch and a second compressed air switch; a compressed air reservoir disposed in the bypass line; and a pressure intensifier disposed in the region between the first compressed air switch and the compressed air reservoir. The second compressed air switch is configured for switching the compressed air flow between the system line and the bypass line.

The pneumatic unit according to the invention can be connected to an external source of compressed air via the compressed air inlet. When the pneumatic unit is used in a motor vehicle workshop, for example, the compressed air inlet enables the pneumatic unit to be connected to a commonly available central compressed air supply. The compressed air outlet then serves for connection to a compressed air-driven device, in particular a hydropneumatic pressure booster.

After the pneumatic unit is connected to the pressure supply, the compressed air flowing into the pneumatic unit is first used to fill the pressure reservoir. For this purpose, the compressed air flows via the first compressed air switch into the bypass line and into the pressure intensifier disposed there. The pressure intensifier increases the inlet pressure of the compressed air flowing in via the compressed air inlet, for example doubles it; this compressed air is then stored in the compressed air reservoir.

The size of the compressed air reservoir can be freely chosen, depending on the amount of compressed air to be made available in the event of a compressed air supply failure. When the pneumatic unit is used for connecting to a hydropneumatic pressure booster, the compressed air reservoir is dimensioned such that the storable air quantity is at least sufficient to be able to carry out one complete operational step with a hydraulic tool connected to the pressure booster. In the instance of a pressing tool, one operational step constitutes completely driving out the working piston of the tool, developing the maximum pressure, and completely retracting the working piston.

In normal operation, i.e. when a constant operating pressure at the required level is applied at the compressed air inlet and the compressed air reservoir is completely filled, compressed air is passed, via the system line of the pneumatic unit, from the compressed air inlet to the compressed air outlet, from which compressed air is supplied to a connected tool, such as the pressure booster. Under these circumstances, the second compressed air switch will be in a first switching status, in which the compressed air flow from the compressed air inlet to the compressed air outlet is made available, whereas the compressed air flow from the compressed air reservoir to the compressed air outlet is blocked.

In the event of a decrease or failure of the compressed air supply connected to the compressed air inlet, the compressed air outlet can be supplied with compressed air by means of activation of the compressed air reservoir. For this purpose, the second compressed air switch is switched to a second valve status, in which the compressed air flow from the compressed air inlet is blocked, and the compressed air flow from the compressed air reservoir is made available. By these means, air stored in the pressure reservoir can be used to carry out or finish at least one operational step.

Thus, particularly when a pressure booster is connected to the compressed air outlet, which pressure booster is used to drive a hydraulic tool, the pneumatic unit according to the invention makes it possible for the hydraulic tool to finish an entire operational process while maintaining the required operating parameters. In a riveting operation, for example, this ensures that the rivet connection has the required strength. Accordingly, it is possible to reliably avoid defective connections.

Basically, any suitable means may be employed for switching the second compressed air switch between the first and second switching status. For example, such means may comprise as needed a manual actuating element to be actuated by the tool operator, such as a foot switch or a hand lever. If it is necessary to reduce the pressure of the compressed air provided by the compressed air reservoir, this can be accomplished by means of pressure reducers on downstream tools or on the pressure booster.

According to an advantageous further embodiment of the invention, it is, however, provided that the second compressed air switch is configured as a pneumatic shuttle valve ("OR valve"), and a pressure control valve is disposed in the region between the compressed air reservoir and the pneumatic shuttle valve. According to this embodiment, a pressure control valve is disposed downstream of the compressed air reservoir, which valve reduces the compressed air provided by the compressed air reservoir to a value slightly below the value of the compressed air at the compressed air inlet, which is then applied to the compressed air switch which is configured as a pneumatic shuttle valve.

In normal operation, the pneumatic shuttle valve is disposed in the first valve status, in which the compressed air stream from the reduced-pressure compressed air reservoir is blocked. If the compressed air flow in the system line at the pneumatic shuttle valve is less than the pressure required for normal operation, the pneumatic shuttle valve then automatically switches into the second valve status, in which the compressed air flow from the compressed air reservoir, at a pressure reduced and adjusted to the pressure for normal operation, is made available, and the system line from the compressed air inlet to the pneumatic shuttle valve is blocked off.

This embodiment of the invention eliminates the need for manual actuation of the second compressed air switch. It is unnecessary to rely on the tool operator to detect a reduction of the compressed air flow at the compressed air inlet, because a reduction which would lead to faulty operation is detected automatically. Thus, faulty operations are avoided, in a particularly reliable manner.

Further, to ensure that a tool, in particular a pressure booster, connected to the pneumatic unit is supplied with compressed air by the pneumatic unit only if the compressed air delivered is at the required operating pressure, according to a further embodiment of the invention an adjustable, pressure-dependent blocking valve is disposed in the region between the compressed air outlet and the second compressed air switch.

The blocking valve, which as a rule is set to the compressed air pressure provided at the compressed air inlet, ensures that the pneumatic unit provides compressed air at the compressed air outlet only if the compressed air does not fall below the required operating pressure. If a sufficiently high operating pressure is not available, for example during the time after the pneumatic unit is connected until the air reservoir is filled, or following discharge of the air reservoir, the blocking valve blocks off the system line downstream of the second compressed air switch, and blocks the operating process of downstream tools or of the pressure booster. According to a particularly advantageous further development of the invention, the blocking valve is controlled via a pressure switch connected to the system line in the region between the second compressed air switch and the blocking valve. In the context of the invention, terms such as "behind," or "downstream," and "ahead of" employed in relation to the compressed air flow refer to the direction of flow of compressed air through the pneumatic unit.

According to a particularly advantageous further embodiment of the invention, it is provided that the pressure switch is connected to a 3/2-way valve that for purposes of controlling the blocking valve, which is configured as a 5/2-way valve, is connected to said blocking valve. This embodiment of the invention is distinguished in that it provides particularly reliable blocking of the system line in the region downstream of the second compressed air switch, when the pressure in the system line falls below the value at which the pressure switch is set.

Due to the integration of the compressed air reservoir, the pneumatic unit according to the invention increases the process reliability of a connected tool, in that, in the event of a disruption, a temporary supply of compressed air is ensured via the compressed air reservoir. With this arrangement, in order to attain reliable operation it is essential that the tool operator detects the disruption, wherein indicating the disruption can occur in any desired manner, for example by means of suitable sensors which are connected to corresponding indicators.

According to a further embodiment of the invention, however, it is provided that a compressed air generator is disposed in the region between the compressed air reservoir and the second compressed air switch. It is a characteristic of the compressed air generator that when compressed air is passed through it, it generates electrical energy. This is brought about, for example, by means of a generator wheel which is driven by the compressed air flow. The electrical energy can then be used to drive any electrically powered functional component, e.g. an indicator device.

Disposition of the compressed air generator between the compressed air reservoir and the second compressed air switch, preferably between the advantageously provided pressure controller and the second compressed air switch, has the result that, during operation, compressed air only flows through the compressed air generator, and the compressed air generator only generates electrical energy when compressed air flows from the compressed air reservoir to the compressed air outlet. Thus, the compressed air generator is activated only in the event of a disruption, so that the compressed air generator operates as a sensor which optionally also serves to supply energy to an indicator unit, which when activated signals a disruption to an operator.

Basically there are a wide range of indicator units which may be chosen to be connected to the compressed air generator. According to a particularly advantageous further embodiment of the invention, however, it is provided that the compressed air generator is connected to an optically functioning and/or acoustically functioning indicator unit. In its simplest embodiment, the indicator unit can be comprised of an LED, which is inactive during normal operation, given that compressed air is not flowing through the compressed air generator. In the event of a disruption, compressed air flows through the compressed air generator, which activates the LED, which indicates to the operator that the compressed air reservoir has been activated and now only a limited number of operations can be carried out, determined by the compressed air reservoir. An acoustic indicator unit can be comprised of, e.g., a simple loudspeaker.

The connection of the compressed air generator to the indicator unit can basically occur in any desired manner, wherein in a particularly simple embodiment of the invention, the compressed air generator is directly connected to an indicator unit which is disposed on the pneumatic unit. According to a particularly advantageous embodiment of the invention, however, it is provided that the compressed air generator is connected to a connecting element for connecting to an indicator unit.

The connecting element is, for example, a plug unit which enables the electrical connection of an external LED. The connecting element thus allows the indicator unit to be disposed at any desired location, from which location suitable electrical lines can be employed to connect the indicator unit to the connecting element, for example the plug unit. As an example, an LED disposed on the hydraulic tool can be connected via the connecting element. If the LED becomes activated, which during normal operation is deactivated, this indicates directly to the tool operator that the pneumatic unit has been switched over to a compressed air supply from the air reservoir. The ability to dispose the indicator unit directly on the hydraulic tool additionally contributes to process reliability.

In general, a wide range of options are possible for the structural design of the pneumatic unit. According to an advantageous embodiment of the invention, however, it has a support frame which has receiving elements for disposing the hydropneumatic pressure booster on the pneumatic unit. Receiving elements which are adapted to the pressure booster enable fixed disposition of the pressure booster on the pneumatic unit. In this way, the pneumatic unit and the pressure booster can form a single subassembly to save space.

According to a particularly advantageous embodiment of the invention, it is provided that the receiving elements are comprised of tubular elements for accommodating support feet. The use of tubular elements of this type enables a stacked disposition of the pneumatic unit and the pressure booster, which saves space. In reference to an orientation employed when the apparatus is in service, the tubular elements thereby extend in the vertical direction, and are spaced apart from each other so that the pressure booster is accommodated with its support feet in the tubular elements.

Other features which are considered as characteristic for the invention are set forth in the appended claims.

Although the invention is illustrated and described herein as embodied in a pneumatic unit for a hydropneumatic pressure booster, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
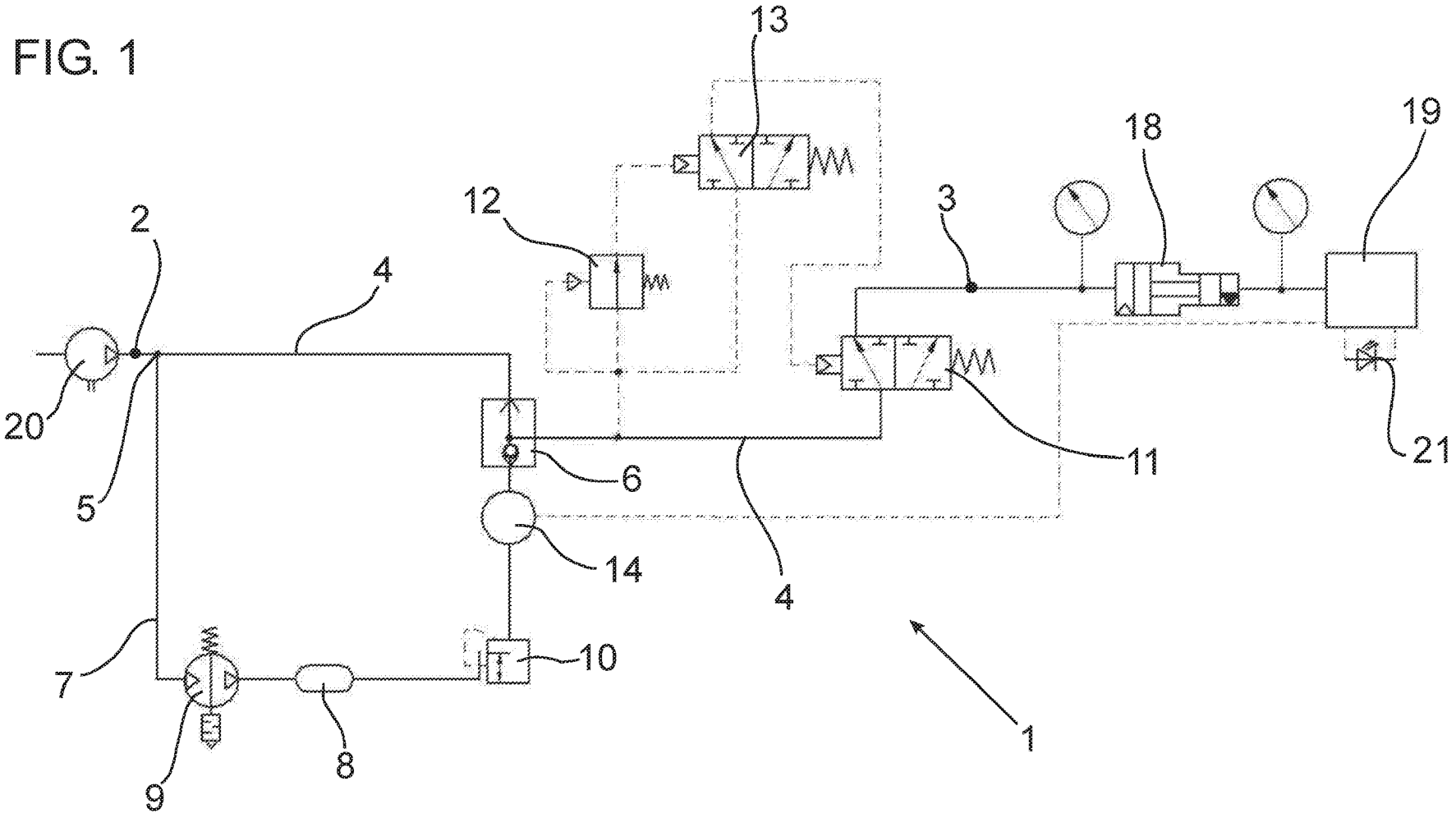
FIG. 1 is a representation of the functioning of a pneumatic unit with a connected pressure booster, in normal operation.
Figure 2:
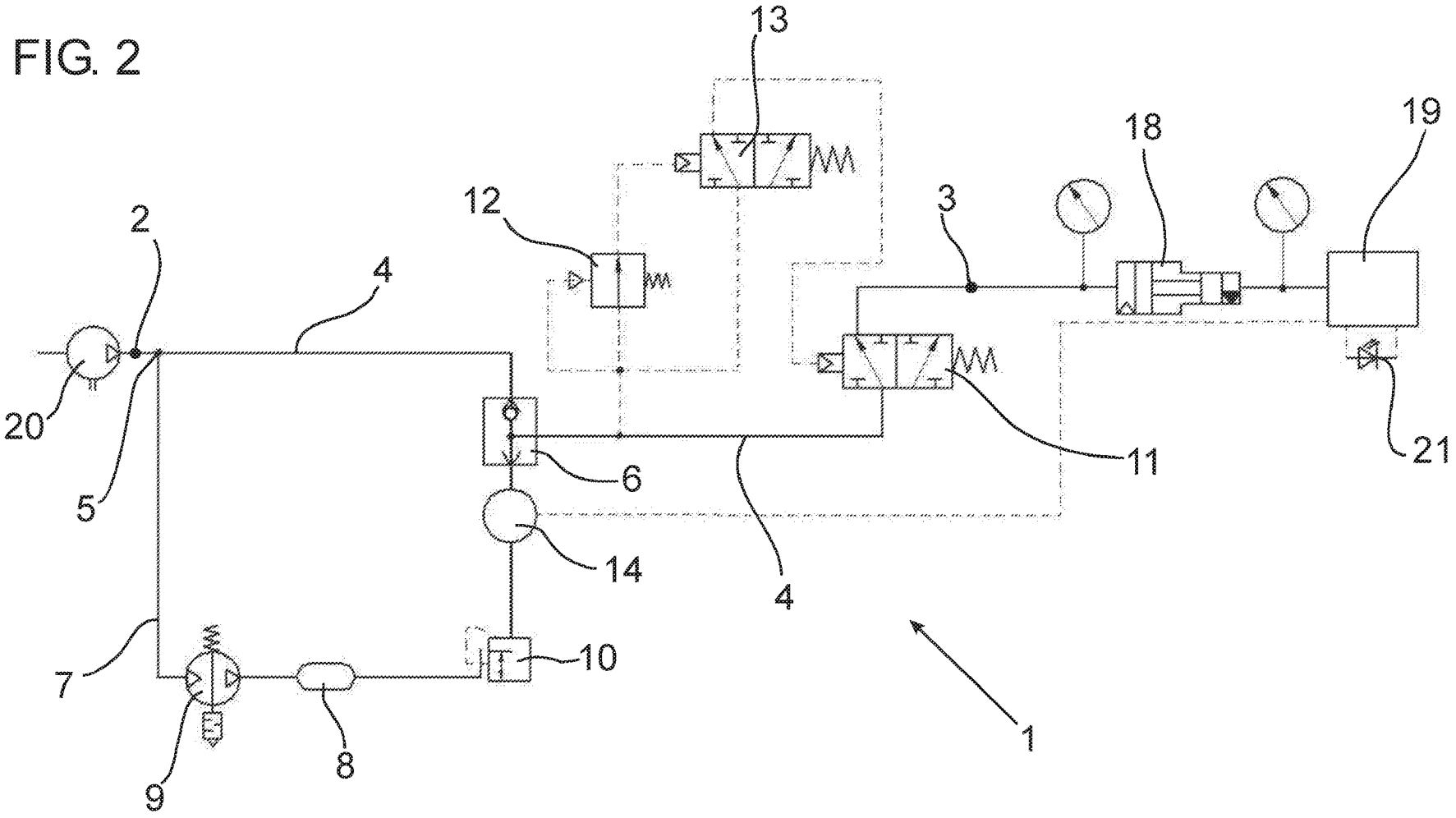
FIG. 2 is a representation of the functioning of the pneumatic unit with a connected pressure booster according to FIG. 1, with compressed air being supplied by an air reservoir of the pneumatic unit.

Referring now to the figures of the drawing in detail and first, particularly, to FIGS. 1 and 2 thereof, there is shown a schematic representation of an exemplary embodiment of a pneumatic unit 1. The pneumatic unit 1 is connected via a compressed air inlet 2 to an external compressed air supply 20, which in motor vehicle workshops is usually at a level of 6 bar. The compressed air flowing into the pneumatic unit 1 via the compressed air inlet 2 is conducted, via a compressed air switch 5, into the system line 4 and a bypass line 7. Via the bypass line 7, the compressed air flow passes into a pressure intensifier 9, which doubles the inlet pressure of the compressed air. A compressed air reservoir 8 connects to the pressure intensifier 9; the compressed air supplied by the pressure intensifier 9 is stored in this reservoir. A pressure control valve 10 connects to the compressed air reservoir 8; this valve reduces the compressed air supplied by the compressed air reservoir 8 to a value slightly below the pressure applied at the compressed air inlet 2, which in the present example is 6 bar. As a result, a pressure applied to the second compressed air switch, which is configured as a pneumatic shuttle valve ("OR valve") 6, and is connected to the pressure control valve 10, is slightly below the line pressure of the system line 4, which is also connected to the pneumatic shuttle valve ("OR valve") 6.

In normal operation as illustrated in FIG. 1, i.e. at a constant line pressure in the system line 4, the pneumatic shuttle valve 6 is in the position illustrated in FIG. 1, in which the compressed air flows via the compressed air inlet 2 and the first compressed air switch 5 via the system line 4 and through the pneumatic shuttle valve 6, in the direction toward a compressed air outlet 3. The compressed air made available from the compressed air reservoir 8 is blocked by the pneumatic shuttle valve 6.

Additionally, a pressure switch 12 is disposed in the region between the pneumatic shuttle valve 6 and the compressed air outlet 3; this switch 12 is configured such that, at a prescribed line pressure, in the present instance 6 bar, it switches a blocking valve 11, which is configured as a 5/2-way valve, via a 3/2-way valve 13, so that the system line 4 makes available the compressed air flow to the compressed air outlet 3.

In the present exemplary embodiment, a pressure booster 18 is disposed at the compressed air outlet 3, which pressure booster converts the pneumatic pressure to a hydraulic pressure which can be used to actuate a hydraulic tool 19 connected to the pressure booster 18, wherein an indicator unit in the form of an LED 21 is disposed on the hydraulic tool 19.

If a pressure decrease or a pressure failure occurs, whereby the pressure in the system line 4 falls below the prescribed value, in the present example 6 bar, then the pneumatic shuttle valve 6 switches into the status illustrated in FIG. 2, in which the compressed air flow from the compressed air reservoir 8 is made available. Accordingly, once the required system pressure is further on applied by the compressed air reservoir 8 in the region of the system line 4 adjoining the pneumatic shuttle valve 6, the pressure switch 12 behaves as in normal operation and makes the compressed air flow available to the compressed air outlet 3 via the 3/2-way valve 13 and the 5/2-way valve 11.

A compressed air generator 14 is disposed in the bypass line 7, in the region between the pressure control valve 10 and the pneumatic shuttle valve 6; the generator 14 generates electricity in the manner of a turbine. When compressed air is supplied to the compressed air outlet 3 via the compressed air reservoir 8, the compressed air driven generator 14 is continuously supplied with compressed air which flows through it, and it generates electrical energy which is conducted via a line to the LED 21 disposed on the hydraulic tool 19, which then starts to emit light. Thereby the LED 21 signals to the tool operator that the pressure available in the system line 4 is insufficient, and that now the pneumatic unit 1 is providing compressed air via the compressed air reservoir 8.

By appropriate dimensioning of the compressed air reservoir 8, the tool operator can, however, at least finish the operation that has been begun (driving out a piston on the hydraulic tool, developing the maximum pressure, and retracting the working piston).

Figure 3:
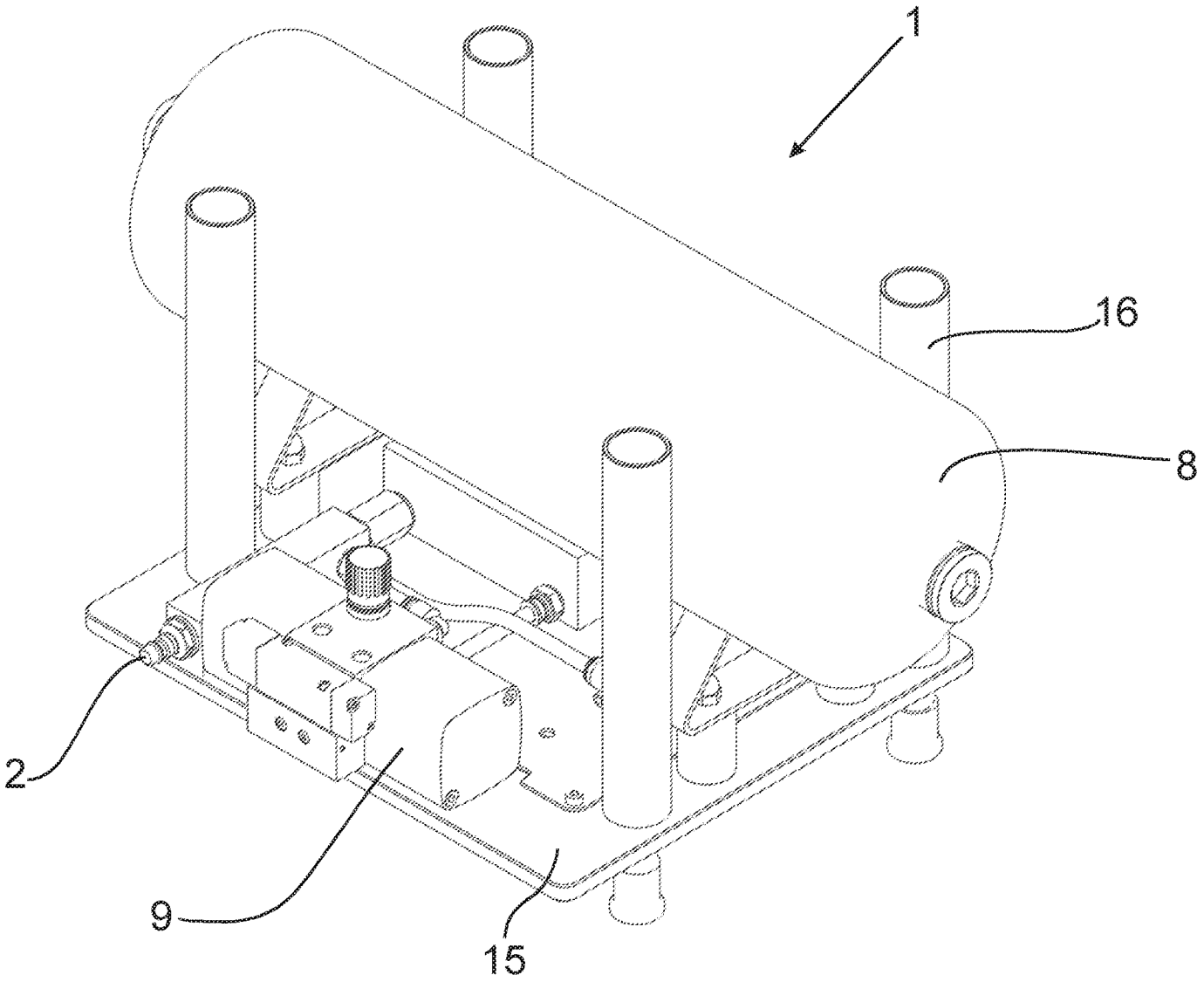
FIG. 3 is a first perspective view of the pneumatic unit according to FIG. 1.
Figure 4:
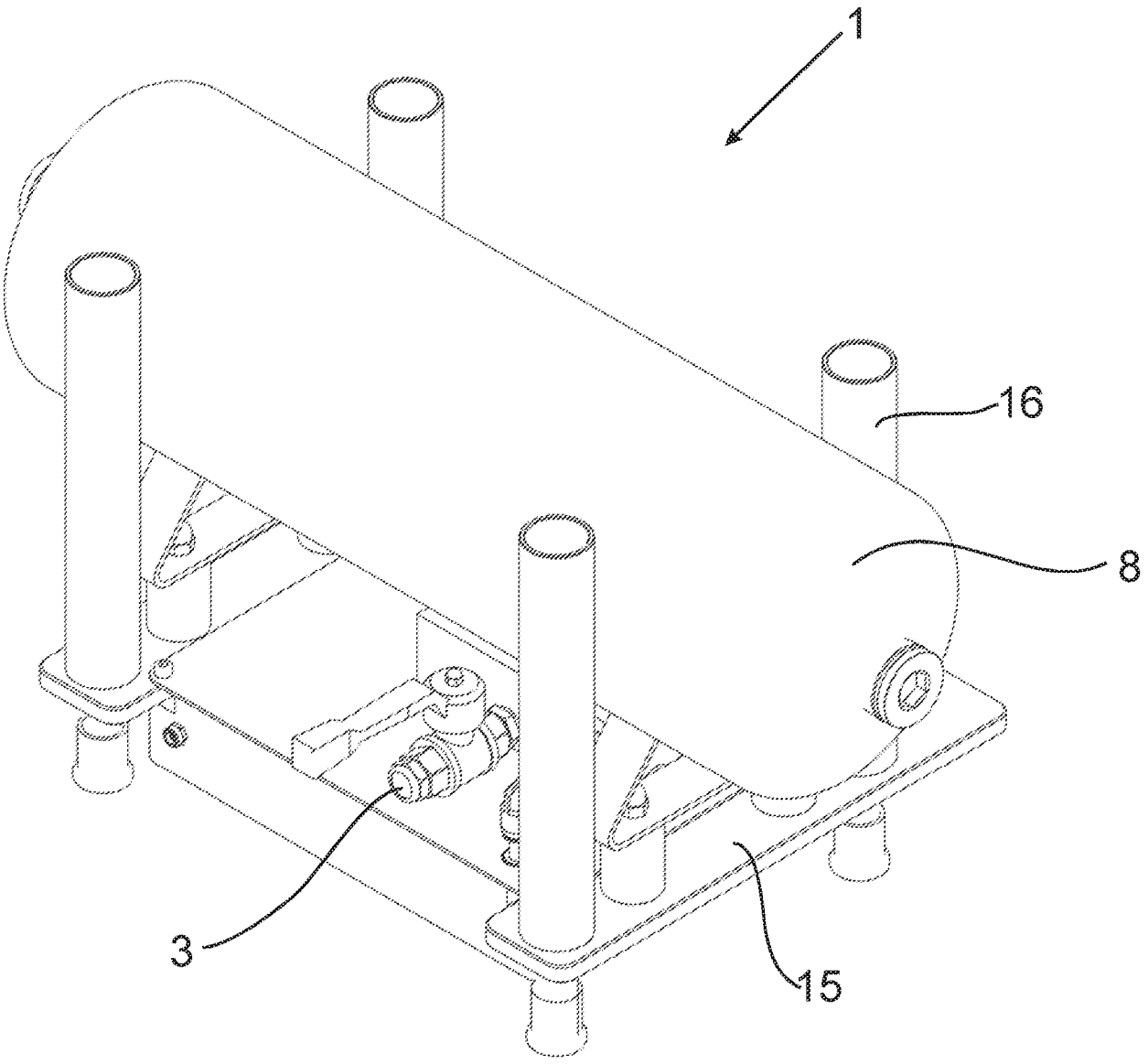
FIG. 4 is a second perspective view of the pneumatic unit according to FIG. 1.
Figure 5:
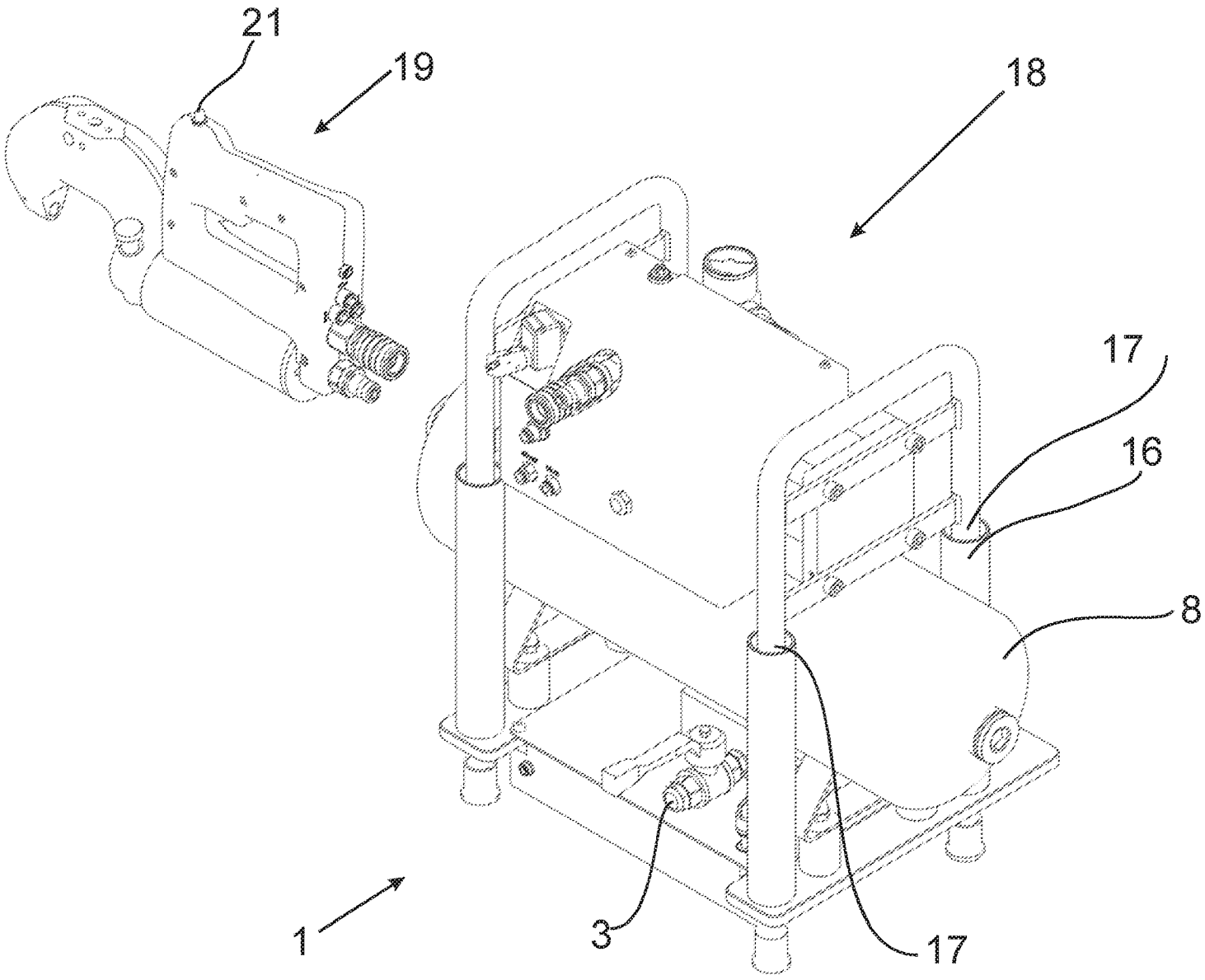
FIG. 5 is a perspective view of the pneumatic unit and pressure booster according to FIG. 1 (disposed adjoining one another), along with an associated hydraulic tool.

FIGS. 3 and 4 are perspective views of the pneumatic unit 1. On a support frame 15 of the pneumatic unit 1, there are, inter alia, four receiving elements configured as tubular elements 16, disposed at a spacing distance from each other. The tubular elements 16 are configured to accommodate support feet 17 of the pressure booster 18. The pneumatic unit 1 and the pressure booster 18 thus form a compact assembly. The pressure booster 18 serves to supply a hydraulic tool 19, via a hydraulic line not illustrated here (see FIG. 5).

The following is a summary list of reference numerals and the corresponding structure used in the above description of the invention:

1 Pneumatic unit
2 Compressed air inlet
3 Compressed air outlet
4 System line
5 First compressed air switch
6 Second compressed air switch/"OR valve"
7 Bypass line
8 Compressed air reservoir
9 Pressure intensifier
10 Pressure control valve
11 Blocking valve/5/2-way valve
12 Pressure switch
13 3/2-way valve
14 Compressed air generator
15 Support frame
16 Receiving elements/tubular elements
17 Support feet
18 Pressure booster
19 Hydraulic tool
20 Compressed air supply
21 Indicator unit/LED

The invention claimed is:

1. A pneumatic unit for a hydropneumatic pressure booster, the pneumatic unit comprising:

a compressed air inlet, a compressed air outlet, and a system line leading from said compressed air inlet to said compressed air outlet;

a bypass line connected in parallel with said system line between said compressed air inlet and said compressed air outlet;

a first compressed air switch and a second compressed air switch connecting said bypass line to said system line;

a compressed air reservoir connected in said bypass line;

a pressure intensifier connected between said first compressed air switch and said compressed air reservoir; and wherein said second compressed air switch is configured to switch a compressed air flow between said system line and said bypass line.

2. The pneumatic unit according to claim 1, wherein said second compressed air switch is a pneumatic shuttle valve being an OR valve, and a pressure control valve is connected between said compressed air reservoir and said pneumatic shuttle valve.

3. The pneumatic unit according to claim 1, which comprises an adjustable pressure-dependent blocking valve disposed between said compressed air outlet and said second compressed air switch.

4. The pneumatic unit according to claim 3, which comprises a pressure switch configured to actuate said blocking valve, said pressure switch being connected to said system line between said second compressed air switch and said blocking valve.

5. The pneumatic unit according to claim 4, wherein said blocking valve is a 5/2-way valve and said pressure switch is connected to a 3/2-way valve which, for controlling said blocking valve, is connected to said blocking valve.

6. The pneumatic unit according to claim 1, which comprises a compressed air generator connected between said compressed air reservoir and said second compressed air switch.

7. The pneumatic unit according to claim 6, wherein said compressed air generator is connected to an optically functioning and/or acoustically functioning indicator unit.

8. The pneumatic unit according to claim 6, wherein said compressed air generator is connected to a connecting element for connection to an indicator unit.

9. The pneumatic unit according to claim 1, which comprises a support frame with receiving elements for mounting the hydropneumatic pressure booster on the pneumatic unit.

10. The pneumatic unit according to claim 9, wherein said receiving elements are tubular elements configured for accommodating support feet.

* * * * *